US006565740B2

(12) United States Patent
Sain et al.

(10) Patent No.: US 6,565,740 B2
(45) Date of Patent: May 20, 2003

(54) PROCESS FOR SWEETENING OF LPG, LIGHT PETROLEUM DISTILLATES BY LIQUID-LIQUID EXTRACTION USING METAL PHTHALOCYANINE SULPHONAMIDE CATALYST

(75) Inventors: Bir Sain, Dehradun (IN); Som Nath Puri, Dehradun (IN); Gautam Das, Dehradun (IN); Bhagwati Prasad Balodi, Dehradun (IN); Sunil Kumar, Dehradun (IN); Anil Kumar, Dehradun (IN); Virendra Kumar Kapoor, Dehradun (IN); Virendra Kumar Bhatia, Dehradun (IN); Turuga Sundara Rama Prasada Rao, Dehradun (IN); Gur Pratap Rai, Mumbai (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 09/817,758

(22) Filed: Mar. 26, 2001

(65) Prior Publication Data

US 2002/0166799 A1 Nov. 14, 2002

(51) Int. Cl.[7] ..... C10G 19/00

(52) U.S. Cl. ..... 208/203; 208/189; 208/204; 208/206; 208/207

(58) Field of Search ..... 208/203, 189, 208/204, 206, 207

(56) References Cited

U.S. PATENT DOCUMENTS 4,088,569 A * 5/1978 Douglas ..... 208/206

* cited by examiner

*Primary Examiner*—Walter D. Griffin
*Assistant Examiner*—James Arnold, Jr.
(74) *Attorney, Agent, or Firm*—Ladas & Parry

(57) ABSTRACT

The present invention related to a process for sweetening of LPG light petroleum distillates by liquid liquid extraction using metal phtalocyanine sulphonamide catalyst which comprises extracting the mercaptanes contain in LPG, light petroleum distillate like pentanes, light straight run naphtha by liquid-liquid extraction using an aqueous or alcoholic solution of alkali metal hydroxide of concentration ranging between 1 wt % to 50 wt % in the presence of a metal phthalocyanine sulphonamide catalyst in the concentration ranging from 5–4000 ppmw, at a temperature ranging from 10° C. to 80° C. at a pressure ranging from 1 kg/cm$^2$–50 kg/cm$^2$ in a continuous or batch manner, converting the mercaptanes present in above said extract into corresponding disulphides by passing air, oxygen or any oxygen containing gas at the above same temperature and pressure, regenerating the alkali solution containing catalyst for recycling by separating the upper layer of disulphides from said alkali solution of catalyst.

22 Claims, No Drawings

PROCESS FOR SWEETENING OF LPG, LIGHT PETROLEUM DISTILLATES BY LIQUID-LIQUID EXTRACTION USING METAL PHTHALOCYANINE SULPHONAMIDE CATALYST

The present invention relates to a process for sweetening of LPG, light petroleum distillates by liquid-liquid extraction using metal phthalocyanine sulphonamide catalyst.

Particularly, the invention relates to a process for sweetening of LPG, light petroleum distillates like pentanes, light straight run naphtha (LSRN), comprising of liquid-liquid extraction of the mercaptans contained therein by alkali solution and regeneration of the mercaptan containing alkali solution by oxygen using metal phthalocyanine sulphonamide catalyst, whereby the mercaptans are converted to corresponding disulphides and the regenerated alkali solution can be reused for mercaptan extraction.

Metal phthalocyanine sulphonamide catalyst has been prepared by a procedure as discussed and described in our co-pending Indian Patent Application No 1032/DEL/2000 corresponding to U.S. patent application Ser. No. 09/804,994.

It is known that the presence of mercaptans in the petroleum products like LPG, naphtha, gasoline, kerosene, ATF etc is highly undesirable due to their foul odour and highly corrosive nature. These are also poisonous to the catalysts and adversely affect the performance of tetraethyl lead as octane booster. Although there are several processes known for the removal of mercaptans from petroleum products, the most common practice is to oxidize the mercaptans present, to less deleterious disulphides with air in the presence of a catalyst. Generally, the lower mercaptans present in LPG, pentanes, LSRN and light thermally cracked naphtha are first extracted in alkali solution and then oxidized to disulphides with air in the presence of a catalyst. The disulphides, being insoluble in alkali solution is separated out from the top and the alkali is regenerated. In the liquid-liquid sweetening the lower mercaptans present in petroleum products like pentanes. LSRN, FCC cracked naphtha etc. are converted to disulphides by direct oxidation with air in the presence of alkali solution and catalyst. The higher molecular weight mercaptans present in petroleum products like heavy naphtha, FCC gasoline, ATF and kerosene are oxidized to disulphides with air in a fixed bed reactor containing catalyst impregnated on a suitable support like activated carbon (Catal. Rev. Sci. Eng. 35(4), 571–609, 1993).

It is also well known that the phthalocyanines of the metals like cobalt, iron, manganese, molybdenum and vanadium catalyze the oxidation of mercaptans to disulphides in alkaline medium. Among these cobalt and vanadium phthalocyanines are preferred. As the metal phthalocyanines are not soluble in aqueous medium, for improved catalytic activity their derivatives like sulphonated and carboxylated metal phthalocyanines are used as catalyst for sweetening of petroleum fractions. For example use of cobalt phthalocyanine monosulphonate as the catalyst in the fixed bed sweetening of various petroleum products (U.S. Pat. Nos. 3,371,031; 4,009,120; 4,207,173; 4,028,269; 4,087,378; 4,141,819; 4,121,998; 4,124,494; 4,124,531) and cobalt phthalocyanine disulphoante (U.S. Pat. No. 4,250,022) tetra sulphonate (U.S. Pat. No. 2,622,763) and the mixture thereof (U.S. Pat. No. 4,248,694) as catalysts for liquid-liquid sweetening and alkali regeneration in mercaptan extraction of light petroleum distillates has been reported. The use of phenoxy substituted cobalt phthalocyanine as sweetening catalyst (Ger Offen 3,816,952), cobalt and vanadium chelates of 2, 9, 16, 23-tetrakis (3,4-dicarboxybenzoyl) phthalocyanine as effective catalyst for both homogeneous and fixed bed mercaptan oxidation (Ger Offen 2,757,476; Fr. Demande 2,375,201) and cobalt, vanadium chelates of tetrapyridinoporphyrazine as active catalysts for sweetening of sour petroleum distillates (Ger Offen 2,441,648) has also been reported.

It is well known that the catalysts used for the sweetening of LPG and light petroleum distillates like pentanes, LSRN etc. by liquid-liquid mercaptan extraction and alkali regeneration are di-, tri- and tetra sulphonates of metal phthalocyanines particularly those of cobalt and vanadium phthalocyanines; cobalt phthalocyanine sulphonates being specially preferred. The cobalt phthalocyanine sulphonates, differ in activity and in their solubility characteristics depending upon the number of sulphonate functionalities leading to problems in their use as catalysts.

Cobalt phthalocyanine disulphonate a commonly used catalyst in sweetening of LPG and light petroleum fractions by liquid-liquid mercaptan extraction and alkali regeneration is extremely dusty in the dry fine powder form and causes handling problem. To overcome this problem cobalt phthalocyanine disulphonate is admixed with water and commonly used as a slurry. However, with insufficient mixing the cobalt phthalocyanine disulphonate precipitates out from the slurry. Moreover, even if the slurry is mixed sufficiently, it retains the cobalt phthalocyanine disulphonate in suspension for a particular length of time only, beyond which the slurry becomes extremely viscous and may form gel, making it very difficult to remove the material from packaging. Cobalt phthalocyanine tetrasulphonate, on the other hand, is highly soluble in water and its use can eliminate precipitation and gel forming problems associated with the use of cobalt phthalocyanine disulphonate. However, it is reported that cobalt phthalocyanine tetrasulphonate has lower catalytic activity than cobalt phthalocyanine disulphonate (U.S. Pat. No. 4,885,268).

In one of our applications 1032/Del/2000 corresponding to U.S. patent application Ser. No. 09/804,994, we reported an improved process for the preparation of metal phthalocyanine sulphonamide catalyst useful for sweetening and obviates the drawback as detailed above.

The main objective of the present invention is to provide a process for sweetening of LPG, light petroleum distillates by liquid-liquid extraction and alkali regeneration using metal phthalocyanine sulphonamide catalyst, which obviates the drawbacks as detailed above.

Accordingly the present invention provides a process for sweetening of LPG, light petroleum distillates by liquid-liquid extraction using metal phthalocyanine sulphonamide catalyst which comprises extracting the mercaptanes contained in LPG, light petroleum distillate like pentanes, light straight run naphtha by liquid-liquid extraction using an aqueous or alcoholic solution of alkali metal hydroxide of concentration ranging between 1 wt % to 50 wt % in the presence of a metal phthalocyanine sulphonamide catalyst in the concentration ranging from 5–4000 ppmw, at a temperature ranging from 10° C. to 80° C., at a pressure ranging from 1 kg/cm$^2$–50 kg/cm$^2$ in a continuous or batch manner, converting the mercaptanes present in above said extract into corresponding disulphides by passing air, oxygen or any oxygen containing gas at the above same temperature and pressure, regenerating the alkali solution containing catalyst for recycling by separating the upper layer of disulphides from said alkali solution of catalyst.

In an embodiment of the present invention metal phthalocyanine sulphonamide catalyst used in selected from the group consisting of cobalt, manganese, nickel, iron, vanadium phthalocyanine sulphonamide and their N-substituted sulphonamide derivatives most preferably cobalt phthalocyanine sulphonamide.

In an embodiment of the present invention the alkali solution used for mercaptan extraction is selected from aqueous or alcoholic solution of alkali metal hydroxides selected from the group consisting of sodium hydroxide, potassium hydroxide, lithium hydroxide, rubidium hydroxide, and cesium hydroxide most preferably aqueous solution of sodium and potassium hydroxide.

In yet another embodiment of the present invention the concentration of the alkali solution used is preferably in the range 7% to 25% by weight.

In yet another embodiment of the present invention the metal phthalocyanine sulphonamide catalyst used is preferably in the concentration ranging between 10 to 1000 ppmw related to alkaline reagent.

In yet another embodiment of the present invention the conversion of mercaptanes to disulphides is effected preferably at 35° C. to 60° C.

In yet another embodiment of the present invention the conversion of mercaptanes to disulphides is effected preferably at 1 kg/cm$^2$ to 15 kg/cm$^2$ pressure.

In yet another embodiment of the present invention the conversion of mercaptanes to disulphides is preferably effected by air.

In still another embodiment of the present invention the regeneration of alkali solution is effected with the mercaptide sulphur ranking from 10 ppmw to 40,000 ppmw in feed stocks.

Process Description

In the sweetening process herein contemplated the undesirable mercaptans contained in LPG and light petroleum distillates like, pentanes, LSRN are extracted with alkali solution containing metal phthalocyanine sulphonamide catalyst through a counter current liquid-liquid extraction. The sweetened petroleum distillate is then passed through an alkali settler and sand filter to remove entrained alkali. The mercaptans and catalyst containing alkali solution obtained from the extractor is oxidized by oxygen or oxygen containing gas like air in on oxidizer whereby the mercaptans present in alkali solution are converted into corresponding disulphides and alkali is regenerated. The disulphide oil being insoluble separates from alkali solution as upper layer and is drained. The regenerated alkali solution is reused for mercaptan extraction.

In the sweetening process with this catalyst system extraction of mercaptans from light petroleum distillates can be effected at 10° C. to 80° C. but the preferred range is 10° C. to 40° C. The extraction can be effected at a pressure from ambient to 50 kg/cm$^2$ or more with the preferable pressure range ambient to 20 kg/cm$^2$. The alkali solution used in the extraction is aqueous/alcoholic solution of alkali metal hydroxide such as sodium hydroxide, potassium hydroxide, lithium hydroxide, rubidium hydroxide, cesium hydroxide, aqueous solution of sodium hydroxide and potassium hydroxide being preferred. The concentration of the alkali solution used is 1% to 50% the preferred range being 7 to 25%.

The sweetening process is effected with the metal phthalocyanine sulphonamide catalyst like cobalt, manganese, nickel, iron and vanadium phthalocyanine sulphonamide and their N-substituted derivatives, the preferred catalyst is cobalt phthalocyanine sulphonamide. The catalyst is used in the concentration 1 to 1000 ppmw related to alkali solution, the preferred range is 10–1000 ppmw.

The regeneration of mercaptans containing alkali solution with metal phthalocyanine sulphonamide catalyst is effected at ambient to 90° C. temperature. The preferred range being 35° C. to 60° C.

The regeneration of alkali solution is effected at atmosphere to 50 Kg/cm$^2$ pressure, the preferred range being 1–15 Kg/cm$^2$.

The regeneration of alkali solution is effected by air, oxygen or any other oxygen containing gas, air being especially preferred.

The following examples are given by way of illustration and therefore should not be construed to limit the scope of the invention.

EXAMPLE 1

Preparation of Cobalt Phthalocyanine Sulphonamide Catalyst as Describe in our Patent Application No. 1032/del/2000

Preparation of Cobalt Phthalocyanine Sulphonyl Chloride

For the preparation of cobalt phthalocyanine sulphonyl chloride, 30 parts by weight of cobalt phthalocyanine were slowly added with stirring to 315 parts by weight of chlorosulphonic acid. The reaction mixture was heated to about 75° C. in one hour and from 75° C. to about 130° C. in 1.5 hours by controlling the heating rate, with constant stirring. The reaction mixture, after maintaining 130–135° C. for additional 4 hours, was cooled to 60–65° C., and then 123 parts of thionyl chloride were slowly added. The whole contents were heated to 79° C. and maintained at this temperature for one hour. The reaction product was cooled to room temperature and slowly added to crushed ice, keeping the temperature preferably below 5° C. The precipitated cobalt phthalocyanine sulphonyl chloride was filtered and washed thoroughly with cold water. The filtered cake was stored wet at 0° C. till further processing.

Preparation of Cobalt Phthalocyanine Sulphonamide

In a typical preparation of cobalt phthalocyanine sulphonamides, total wet cake of cobalt phthalocyanine sulphonyl chloride, obtained was dispersed in 900 parts of ice water and 190 parts of methanol added to get homogeneous dispersion. The reaction mixture was stirred at 5–8° C. and ammonia gas was passed till the mixture was fairly alkaline (pH 8–9). Pyridine (1.2 parts) was then added and the mixture stirred at room temperature for 20 minutes. This was followed by addition of 6 parts of 10% sodium hydroxide solution followed by stirring the reaction mixture for 40 minutes at room temperature. The contents were then heated to 80° C. and after maintaining at this temperature for 1 hour, cooled to room temperature and poured over a mixture of ice and concentrated hydrochloric acid keeping the pH fairly acidic (2–3). The precipitated cobalt phthalocyanine tetrasulphonamide was filtered, washed thoroughly with cold water and dried in vacuum oven to yield 44 gms of the product. The FAB mass spectral analysis of the sulphonamide obtained using cobalt phthalocyanine as the starting material showed the presence of tetra sulphonamide as the major isomer, followed by trisulphonamide and disulphonamide isomers.

EXAMPLE 2

Alkali Regeneration in LPG Mercaptan Extraction

As the metal phthalocyanine sulphonamide catalyst has no effect in mercaptan extraction from LPG and it only catalyze the oxidation of mercaptide to disulphide to regenerate the caustic being used for extraction, the experiments were designed to study caustic regeneration by using ethane thiol mercaptan as the model mercaptan.

In the model experiments the calculated amount of ethyl mercaptan was added to light naphtha. Its mercaptan sulphur content was estimated by UOP method 163-89. Thus prepared feed was taken in a round bottom flask. The mercaptan present in naphtha was extracted with 14% aqueous sodium hydroxide solution containing 200 ppmw of the catalyst with stirring under inert atmosphere. After extraction the mercaptan sulphur content of naphtha was estimated. The spent alkali thus obtained, was regenerated by passing air into it. The alkali regeneration time (as indicated by reappearance of the blue colour in the solution) was monitored in the repeated experiments by reusing the same catalyst solution. The strength of the sodium hydroxide solution was also monitored. The mercaptide sulphur content of the regenerated sodium hydroxide solution was found to be below 1 ppmw by above method (UOP 163-89) throughout the entire study showing complete alkali regeneration. Results are given in Table-1.

TABLE 1

| | |
|---|---|
| Mercaptan sulphur in feed, 'S'ppmw | 1500 |
| Catalyst concentration in alkali ppmw | 200 |
| Volume of alkali taken for extraction | 50 ml |

| Volume of feed treated with alkali ml | Commutative volume of feed treated ml | Mercaptan in extracted feed 'S' ppmw | Alkali regeneration time, min. | NaSR in regenerated alkali ppmw |
|---|---|---|---|---|
| 300 | 300 | <5 | 10.5 | <1 |
| 300 | 600 | <5 | 12.0 | <1 |
| 300 | 900 | <5 | 12.0 | <1 |
| 300 | 1200 | <5 | 12.5 | <1 |
| 300 | 1500 | <5 | 15.0 | <1 |
| 150 | 1650 | <5 | 12.0 | <1 |

EXAMPLE 3

Alkali Regeneration in LPG Mercaptan Extraction in Glass Column

As the metal phthalocyanine sulphonamide catalyst has no effect in mercaptan extraction from LPG and it only catalyze the oxidation of mercaptide to disulphide to regenerate the alkali solution used for extraction, experiments were designed to study caustic regeneration by using ethane thiol as the model mercaptan. The laboratory experimental set-up consist of a glass column with air inlet at the bottom connected to air cylinder through control valve. Calculated amount of ethane thiol was added to 14% aqueous sodium hydroxide containing 200 ppmw metal phthalocyanine sulphonamide catalyst and its mercaptan sulphur content was estimated by UOP method 163-89. The mixture was then transferred to the glass column and oxidized by passing air till all the ethyl mercaptide was converted to disulphide indicated by the appearance of blue colour. Thus formed diethyl disulphide clearly separated from catalyst containing alkali solution in the upper layer. The conversion of mercaptide to disulphide was monitored by analyzing the mercaptide concentration in the reaction mixture at different intervals. The results are given in Table-2.

TABLE 2

| | |
|---|---|
| Mercaptan sulphur in 14% sodium hydroxide solution ppmw | 3307 |
| Concentration of the catalyst in alkali solution ppmw | 200 |
| Total volume of reaction mixture, taken ml | 230 |
| Air rate, lit/min | 0.8 |

| Time, min | Mercaptan 'S', | Conversion, wt % |
|---|---|---|
| 0 | 3307 | 0 |
| 1 | 2816 | 14.85 |
| 5 | 45 | 98.64 |
| 8 | 0 | 100.00 |

EXAMPLE 4

Alkali Regeneration in LPG Mercaptan Extraction in Glass Column

Procedure followed and experimental details were same as given in Example 3. The results obtained are presented in Table-3.

TABLE 3

| | |
|---|---|
| Mercaptan sulphur in 14 % sodium hydroxide solution ppmw | 8533 |
| Concentration of the catalyst in alkali solution ppmw | 200 |
| Total volume of reaction mixture, taken ml | 230 |
| Air rate, lit/min | 0.83 |

| Time, min | Mercaptan 'S' ppmw | Conversion, wt % |
|---|---|---|
| 0 | 8533 | 0 |
| 1 | 6220 | 27.11 |
| 5 | 5042 | 40.91 |
| 10 | 1833 | 78.52 |
| 15 | 0 | 100.00 |

EXAMPLE 5

Alkali Regeneration in LPG Mercaptan Extraction in Glass Column

Procedure followed and experimental details were same as given in Example 3. Thus obtained are presented in Table-4.

TABLE 4

| | |
|---|---|
| Mercaptan sulphur in 14% solution hydroxide solution ppmw | 13129 |
| Concentration of the catalyst in alkali solution ppmw | 200 |
| Total volume of reaction mixture, taken ml | 230 |
| Air rate, lit/min | 0.8 |

| Time, min | Mercaptan 'S' ppmw | Conversion, wt % |
|---|---|---|
| 0 | 13129 | 0 |
| 1 | 12251 | 6.69 |
| 10 | 7337 | 44.12 |
| 20 | 1101 | 91.61 |
| 25 | 0 | 100.00 |

EXAMPLE 6

Alkali Regeneration in LPG Mercaptan Extraction in Glass Column

Procedure followed and experimental details were same as given in Example 3. The results obtained are presented in Table-5.

TABLE 5

| | |
|---|---|
| Mercaptan sulphur in 14% sodium hydroxide solution ppmw | 17626 |
| Concentration of the catalyst in alkali solution ppmw | 200 |
| Total volume of reaction mixture, taken ml | 230 |
| Air rate, lit/min | 0.075 |

| Time, min | Mercaptan 'S' ppmw | Conversion, wt % |
|---|---|---|
| 0 | 17626 | 0 |
| 1 | 16663 | 5.46 |
| 10 | 8140 | 53.82 |
| 20 | 1664 | 90.56 |
| 29 | 0 | 100.00 |

We claim:

1. A process for sweetening of LPG, light petroleum distillates by liquid-liquid extraction using metal phthalocyanine sulphonamide catalyst which comprises the steps of: extracting the mercaptans contained in LPG, light petroleum distillate or light straight run naphtha by liquid-liquid extraction using an aqueous or alcoholic solution of alkali metal hydroxide of disulphides by using air.

2. A process as claimed in claim 1, wherein metal phtalocyanine sulphonamide catalyst used is selected from the group consisting of cobalt, manganese, nickel, iron, vanadium phthalocyanine sulphonamide and their N-substituted sulphonamide derivatives most preferably cobalt phthalocyanine sulphonamide.

3. A process as claimed in claim 1, wherein the alkali solution used for mercaptan extraction is selected from aqueous or alcoholic solution of alkali metal hydroxide selected from the group consisting of sodium hydroxide, potassium hydroxide, lithium hydroxide, rubidium hydroxide and cesium hydroxide most preferably aqueous solution of sodium and potassium hydroxide.

4. A process as claimed in claim 1, wherein concentration of the alkali solution used is preferably in the range 7% to 25% by weight.

5. A process as claimed in claim 1, wherein the metal phthalocyanine sulphonamide catalyst used is preferably in the concentration ranging between 10 to 1000 ppmw related to alkaline reagent.

6. A process as claimed in claim 1, wherein the conversion of mercaptanes to disulphides is effected preferably at 35° C. to 60° C.

7. A process as claimed in claim 1, wherein the conversion of mercaptanes to disulphides is effected preferably at 1 $kg/cm^2$ to 15 $kg/cm^2$ pressure.

8. A process as claimed in claim 1, wherein the conversion of mercaptanes to disulphides is preferably effected by air.

9. The process as claimed in claim 1, wherein the regeneration of the solution is effected with a feed stock containing sulphur in an amount ranging from 10 ppmw to 40,000 ppmw.

10. The process as claimed in claim 2, wherein the alkali solution used for mercaptan extraction is selected from aqueous or alcoholic solution of alkali metal hydroxide selected from the group consisting of sodium hydroxide, potassium hydroxide, lithium hydroxide, rubidium hydroxide and cesium hydroxide.

11. The process as claimed in claim 2, wherein concentration of the alkali solution used is in the range 7% to 25% by weight.

12. The process as claimed in claim 3, wherein concentration of the alkali solution used is in the range 7% to 25% by weight.

13. The process as claimed in claim 2, wherein the metal phthalocyanine sulphonamide catalyst used is in the concentration ranging between 10 to 1000 ppmw related to alkaline reagent.

14. The process as claimed in claim 3, wherein the metal phthalocyanine sulphonamide catalyst used is in the concentration ranging between 10 to 1000 ppmw related to alkaline reagent.

15. The process as claimed in claim 4, wherein the metal phthalocyanine sulphonamide catalyst used is in the concentration ranging between 10 to 1000 ppmw related to alkaline reagent.

16. The process as claimed in claim 2, wherein the conversion of mercaptans to disulphides is effected at 35° C. to 60° C.

17. The process as claimed in claim 3, wherein the conversion of mercaptans to disulphides is effected at 35° C. to 60° C.

18. The process as claimed in claim 4, wherein the conversion of mercaptans to disulphides is effected at 35° C. to 60° C.

19. The process as claimed in claim 5, wherein the conversion of mercaptans to disulphides is effected at 35° C. to 60° C.

20. The process according to claim 1 wherein the metal phthalocyanine sulphonamide catalyst is cobalt phthalocyanine sulphonamide.

21. The process as claimed in claim 1 wherein the solution of alkali metal hydroxide is an aqueous solution of sodium and potassium hydroxide.

22. The process as claimed in claim 2 wherein the solution of alkali metal hydroxide is an aqueous solution of sodium and potassium hydroxide.

* * * * *